US007631960B2

(12) United States Patent
Cheng et al.

(10) Patent No.: US 7,631,960 B2
(45) Date of Patent: Dec. 15, 2009

(54) INK JET DEVICE AND METHOD FOR OPERATING INK JET DEVICE

(75) Inventors: Chen-Hsing Cheng, Hsinchu (TW); Tsung-Yu Hung, Hsinchu (TW)

(73) Assignee: ICF Technology Limited, Santa Clara ( * ) Notice: Subject to any disclaimer, the term of this patent is extended or adjusted under 35 U.S.C. 154(b) by 447 days.

(21) Appl. No.: 11/565,526

(22) Filed: Nov. 30, 2006

(65) Prior Publication Data

US 2008/0030537 A1 Feb. 7, 2008

(30) Foreign Application Priority Data

Aug. 4, 2006 (TW) ..... 95128630 A

(51) Int. Cl.
*B41J 2/175* (2006.01)

(52) U.S. Cl. ..... 347/85

(58) Field of Classification Search ..... 347/17, 347/84, 85

See application file for complete search history.

(56) References Cited

U.S. PATENT DOCUMENTS 6,883,905 B2 * 4/2005 Kimura et al. ..... 347/85

FOREIGN PATENT DOCUMENTS

JP 358147347 * 9/1983

* cited by examiner

*Primary Examiner*—Anh T. N. Vo

(57) ABSTRACT

An ink jet device includes a print head, an ink tank containing ink therein, a first motor, a second motor, and a control unit. The ink tank is connected with the print head and configured for supplying ink to the print head. The ink contained in the ink tank exerting a static hydraulic pressure onto the print head. The first motor is configured for driving the print head to move in a direction selected from the group consisting of a vertical direction, a horizontal direction, and a combination thereof. The second motor is configured for substantially simultaneously driving the ink tank to move in response to vertical movement of the print head so as to maintain the static hydraulic pressure that the ink exerts on the print head.

7 Claims, 1 Drawing Sheet

INK JET DEVICE AND METHOD FOR OPERATING INK JET DEVICE

BACKGROUND OF THE INVENTION

1. Field of the Invention

The present invention generally relates to an ink jet device and a method for operating the ink jet device.

2. Description of Related Art

With recent advances in personal computers, especially portable personal computers, the demand tends to arise for liquid crystal displays, especially color liquid crystal displays. However, in order to further popularize the use of liquid crystal displays, a reduction in cost must be achieved. Especially, it is required to reduce the cost of a color filter, which occupies a large proportion of the total cost of the liquid crystal display (LCD).

Various methods have been tried to satisfy the required characteristics of the color filters while meeting the above requirements. Ink jet method is one of the methods. In the ink jet method, RGB (red, green, and blue) color layer is formed by jetting ink into spaces formed on a substrate using an ink jet device. RGB color layer can be formed at once and the efficiency of material is increased, thus decreasing the cost of the color filter. Therefore, ink jet devices are becoming more popular in manufacturing of color filters.

In the ink jet device, a pressure difference between a print head and an ink tank is kept constant so as to maintain a good printing performance. However, the print head moves upward and downward in a vertical direction in printing, for example, returning to a home position along the vertical direction. In a typical ink jet device, the pressure difference varies due to a change of a height of the print head, thus causing ink leakage from the print head, or causing the print head to suck in air. In this case, the printing performance of the ink jet device is weakened, and maintenance time for the ink jet device is increased.

It is therefore desirable to find a new ink jet device and a new method, which can overcome the above mentioned problems.

SUMMARY OF THE INVENTION

In a preferred embodiment, an ink jet device includes a print head, an ink tank containing ink therein, a first motor, a second motor, and a control unit. The ink tank is connected with the print head and configured for supplying ink to the print head. The ink contained in the ink tank exerts a static hydraulic pressure on the print head. The first motor is configured (i.e., structured and arranged) for driving the print head to move in a direction selected from the group consisting of a vertical direction, a horizontal direction, and a combination of the vertical direction and the horizontal direction (i.e., a slant direction). The second motor is configured for substantially simultaneously driving the ink tank to move in response to vertical movement of the print head so as to maintain the static hydraulic pressure that the ink exerts on the print head.

BRIEF DESCRIPTION OF THE DRAWINGS

Many aspects of embodiments can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE INVENTION

Figure 1:
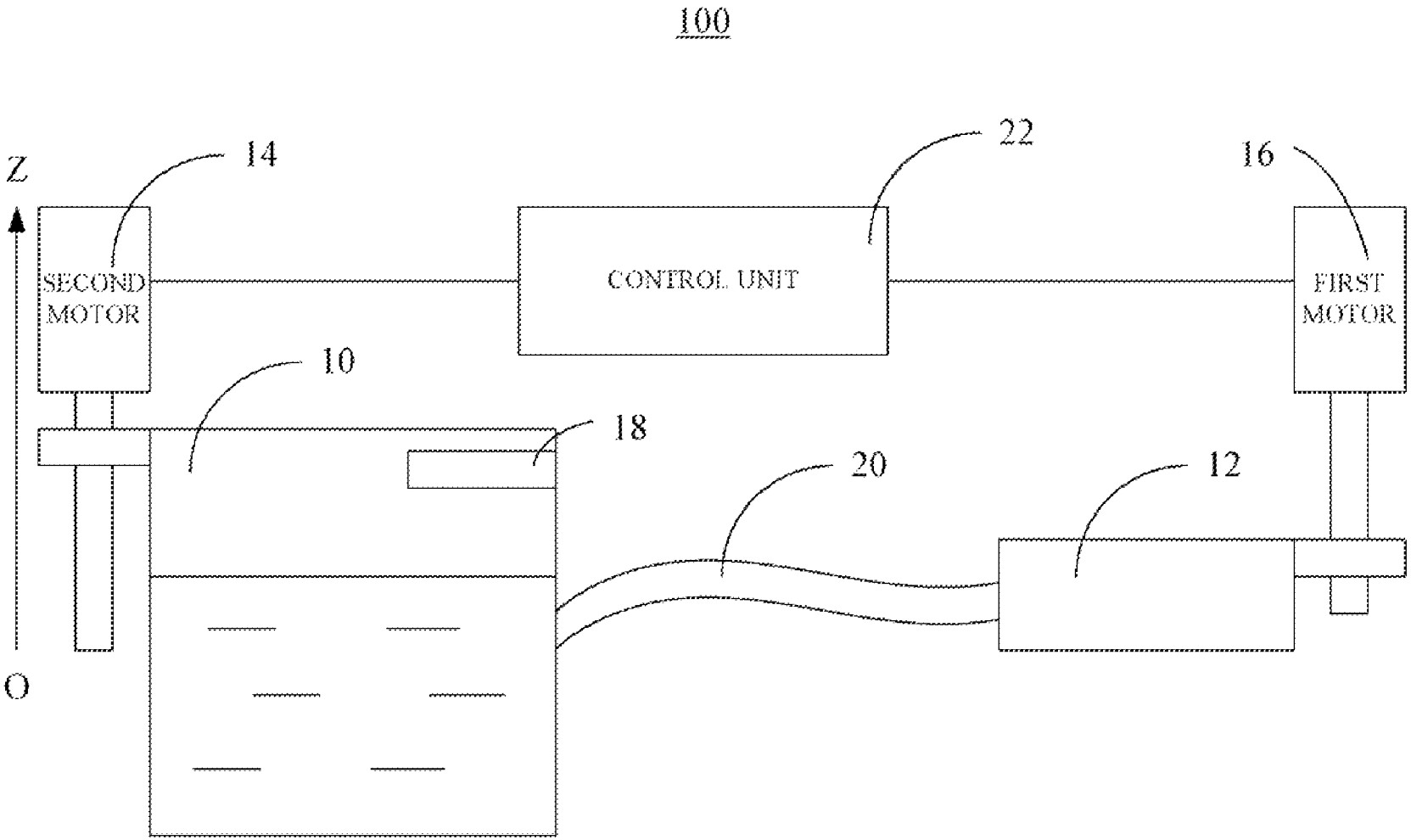
FIG. 1 is a schematic view of an ink jet device according to a preferred embodiment.

Embodiments will now be described in detail below with reference to the drawing.

Referring to FIG. 1, an ink jet device 100 includes an ink tank 10 containing ink therein, a print head 12, a control unit 22, a first motor 16, a second motor 14, and a sensor 18. The ink tank 10 is connected to the print head 12 using a pipe 20 and is configured for supplying ink to the print head 12. The ink in the ink tank 10 exerts a static hydraulic pressure onto the print head 12. The sensor 18 is arranged in the ink tank 10 and configured for monitoring an ink level of the ink in the ink tank 10. The first motor 16 and the second motor 14 are connected with the control unit 22 electrically. The first motor 16 is connected with the print head 12 and drives the print head 12 to move in a direction selected from the group consisting of a vertical direction (i.e., Z axis), a horizontal direction (not labeled) and a combination thereof. The second motor 14 is connected with the ink tank 10 and configured for substantially simultaneously driving the ink tank 10 to move in response to vertical movement of the print head 12 so as to maintain the static hydraulic pressure that the ink exerts on the print head 12. The ink in the ink tank 10 is kept in a constant ink level. When the sensor 18 detects that an ink level of the ink is less than the constant ink level, ink is supplied into the ink tank 10 automatically. The sensor 18 can be an ultrasonic displacement sensor, or a pressure sensor.

When the first motor 16 drives the print head 12 to move upward along the Z axis, the second motor 14 enabled by the control unit 22 drives the ink tank 10 to move upward a same distance along the Z axis as the print head 12. When the first motor 16 drives the print head 12 to move downward along the Z axis, the second motor 14 drives the ink tank 10 to move downward a same distance along the Z axis as the print head 12. Therefore, a pressure difference between the ink tank 10 and the print head 12 is kept constant while the print head 12 moves upward or downward along the Z axis. In other words, the static hydraulic pressure that the ink exerts on the print head 12 is maintained.

Referring to FIG. 1 again, a method for operating an ink jet device 100 includes the following steps:

In step 1, the print head 12 is driven to move in a direction selected from the group consisting of a vertical direction (i.e., the Z axis), a horizontal direction (not labeled) and a combination thereof.

In step 2, the ink tank 10 is substantially simultaneously driven to move in response to vertical movement of the print head 12 so as to maintain the static hydraulic pressure that the ink exerts on the print head 12. That is, when the print head 12 is driven to move along the Z axis, the ink tank 10 is driven to moved a same distance along a same direction as the print head 12.

The print head 12 can be driven by the first motor 16, and the ink tank 10 can be driven by the second motor 14. Both the first motor 16 and the second motor 14 are connected electrically with the control unit 22, and are controlled by the control unit 22. When the first motor 16 drives the print head 12 to move upward along the Z axis, the second motor 14 enabled by the control unit 22 drives the ink tank 10 to move upward a same distance along the Z axis as the print head 12. When the first motor 16 drives the print head 12 to move downward along the Z axis, the second motor 14 drives the ink tank 10 to move downward a same distance along the Z axis as the print head 12.

In the ink jet device of the present embodiment, the static hydraulic pressure of the ink exerted on the print head is kept constant while the print head moves along the Z axis. Therefore, ink leakage from the print head is avoided as well as air being sucked into the print head while the print head moves along the Z axis. In this case, the printing performance of the ink jet device is improved, and time for maintenance of the ink jet device is decreased. The present method for keeping a constant pressure difference between the print head and ink tank in ink jet device achieves the same advantages as the ink jet device.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. An ink jet device comprising:

a print head;

an ink tank connected with the print head, the ink tank containing ink therein and being configured for supplying the ink to the print head, the ink contained in the ink tank exerting a static hydraulic pressure thereof onto the print head;

a first motor configured for driving the print head to move in a direction selected from the group consisting of a vertical direction, a horizontal direction, and a combination of the vertical direction and the horizontal direction; and a second motor configured for substantially simultaneously driving the ink tank to move in response to vertical movement of the print head so as to maintain the static hydraulic pressure that the ink exerts on the print head.

2. The ink jet device as claimed in claim 1, further comprising a sensor arranged in the ink tank, the sensor being configured for monitoring an ink level of the ink in the ink tank.

3. The ink jet device as claimed in claim 2, wherein the sensor is selected from the group consisting of an ultrasonic displacement sensor and a pressure sensor.

4. The ink jet device as claimed in claim 1, further comprising a control unit for controlling the first motor and the second motor.

5. A method for operating an ink jet device, the ink jet device comprising an ink tank and a print head, the ink tank being connected with the print head, the ink tank containing the ink therein and being configured for supplying ink to the print head, the ink contained in the ink tank exerting a static hydraulic pressure thereof onto the print head, the method comprising the steps of:

driving the print head to move in a direction selected from the group consisting of a vertical direction, a horizontal direction, and a combination of the vertical direction and the horizontal direction; and substantially simultaneously driving the ink tank to move in response to vertical movement of the print head so as to maintain the static hydraulic pressure that the ink exerts onto the print head.

6. The method as claimed in claim 5, wherein movement of the print head is driven by a first motor.

7. The method as claimed in claim 5, wherein movement of the ink tank is driven by a second motor.

* * * * *

UNITED STATES PATENT AND TRADEMARK OFFICE

CERTIFICATE OF CORRECTION

PATENT NO. : 7,631,960 B2
APPLICATION NO. : 11/565526
DATED : December 15, 2009
INVENTOR(S) : Cheng et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 462 days.

Signed and Sealed this

Second Day of November, 2010

David J. Kappos

David J. Kappos
*Director of the United States Patent and Trademark Office*